US005941742A

United States Patent [19]

Whitaker

[11] Patent Number: 5,941,742

[45] Date of Patent: Aug. 24, 1999

[54] TROLLING MOTOR MOUNT

[76] Inventor: Mark E. Whitaker, 30 Greenfield Rd., North Waterboro, Me. 04061

[21] Appl. No.: 08/838,425

[22] Filed: Apr. 7, 1997

[51] Int. Cl.[6] ..... B63H 20/02

[52] U.S. Cl. ..... 440/1; 114/364; 248/640; 440/6

[58] Field of Search ..... 248/640, 642, 248/643, 641; 440/6, 7, 1, 53, 62, 63; 114/364; 200/537, 538, 540, 542

[56] References Cited

U.S. PATENT DOCUMENTS

| | | | |
|---|---|---|---|
| 2,878,768 | 3/1959 | Warblow | 440/62 |
| 3,807,343 | 4/1974 | Peebles | 440/1 |
| 3,881,443 | 5/1975 | Hamp | 248/640 |
| 4,382,574 | 5/1983 | Ellestad | 248/641 |
| 4,728,307 | 3/1988 | Burgess | 440/7 |
| 5,041,030 | 8/1991 | Payne, Sr. | 440/6 |
| 5,292,269 | 3/1994 | Plost et al. | 440/1 |
| 5,499,792 | 3/1996 | Tamiso | 248/643 |

*Primary Examiner*—Sherman Basinger
*Attorney, Agent, or Firm*—Thomas L. Bohan & Associates

[57] ABSTRACT

A motor mount device for adjustably positioning the location of a motor on a watercraft. The device includes three rail clamps designed to create three points of contact between the device and the gunwales of the watercraft. Two clamps are positionable on one side of the craft, with one having a motor mount placeable outboard of the watercraft. The third clamp is located across from the clamp that includes the motor mount and the coupling between those two clamps is provided via an incrementally adjustable cross member. The adjustability of the length of the cross member permits the device to be placed at most any boat width. A thruster plate and the arrangement of the clamps ensures maximum transfer of thrust of the motor to movement of the watercraft. An optional safety switch controls power to the motor such that when undesired or unexpected movement of the propeller out of the water occurs, the power to the motor will automatically be cut off.

5 Claims, 6 Drawing Sheets

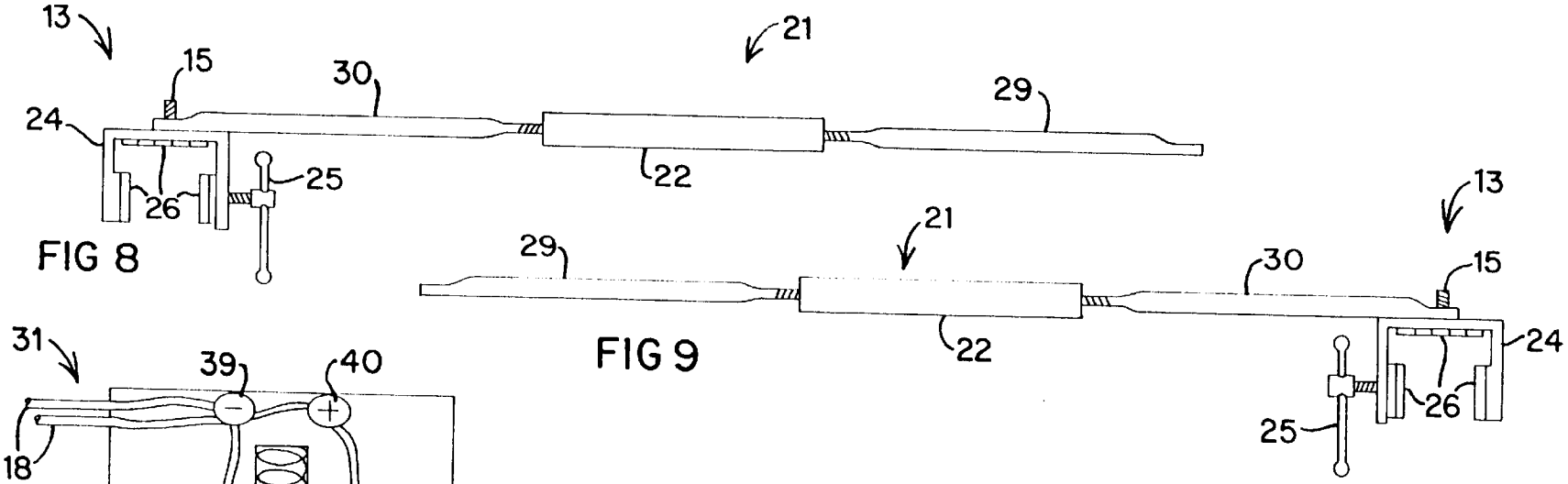
FIG 8
FIG 9
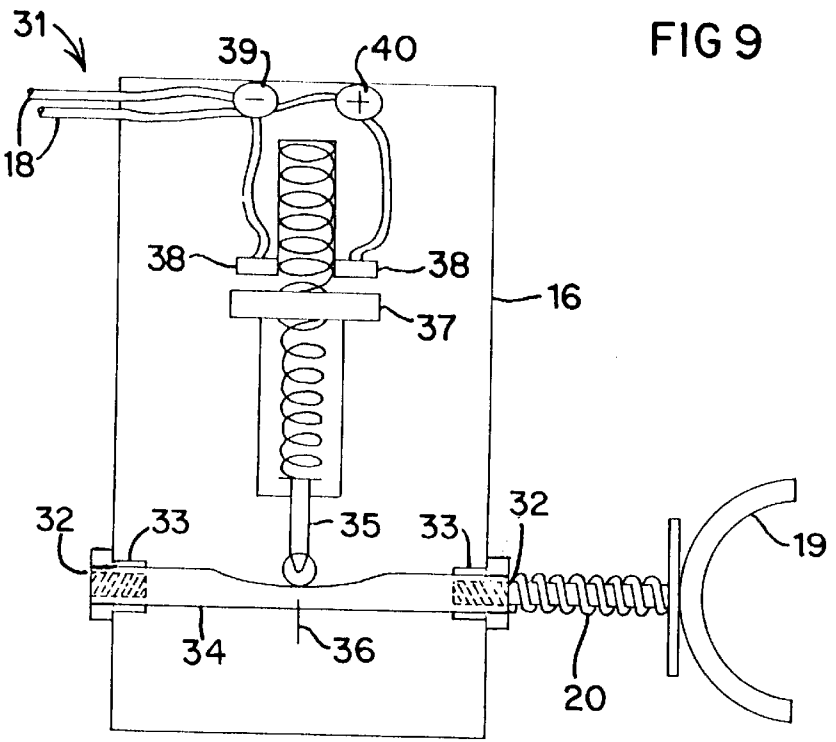
FIG 10

TROLLING MOTOR MOUNT

BACKGROUND OF THE INVENTION

1. Field of Invention

The present invention relates to the field of marine motor support devices. More particularly, the present invention relates to a device for providing a mount for a trolling motor. More particular yet, the present invention involves a trolling motor mount that provides side-mounting and that also includes an internal safety switch integrated into the mount.

2. Description of Prior Art

In the field of watercraft used to transport fishermen, casual boaters, and the like, trolling motors have been useful devices. These motors are relatively small in comparison to the types of primary motors designed to propel watercraft at significant speeds. The principal function of the trolling motor is to enable movement of the craft at relatively slow speeds in order to permit fine control of that watercraft movement. Their usefulness is not limited to small craft such as canoes, rowboats and the like. That is, they may also be found on relatively larger craft, such as sailboats, yachts, etc. However, trolling motors are particularly useful to the fisherman in that they keep the craft moving at a speed comparable to the speed of a typical lure used for a particular type of target fish.

For many years, there have been developments in the field of trolling motors. The focus of the present invention is not in the specific motor design, but in the design of the motor's mount. There have been many such designs, all of which have had their usefulness, but none of which have addressed all of the needs of the fisherman—or any sailor—who seeks to be able to maneuver the craft from most any position within a small vessel. That is, particularly for the individual boating alone, it can be difficult to move about the craft while at the same time operate the trolling motor. In most designs, the trolling motor is affixed to a substrate that places the motor's propeller, when in use, in the water and the control fixtures associated with operation of the motor at the stern of the craft. As long as the user does not wish to move far from the stern-mounted motor and its hand-operated controls, this standard design is acceptable. Unfortunately, this restricts the user to the rear of the craft where overall balance may be less than ideal—an issue of particular concern to the canoeist, whose craft is already relatively unstable. Further, it restricts the solo user from fully accessing the entire craft, unless, of course, he or she is prepared to risk free motion of the motor when his or her hand is not there to control that movement.

There have been several attempts to provide trolling motor mounts permitting greater movement around the craft without loss of complete control of the motor. For example, U.S. Pat. No. 5,499,792 issued to Tamiso describes a trolling motor mount having a two-point contact bar used to provide a site for affixing the motor. The contact bar includes slots permitting coarse adjustment of the location of clamps used to affix the bar to differing gunwale widths. The mounting bar is apparently designed to be affixed at or near the front of the craft, with the motor mounted outboard at the end of the bar. While the Tamiso device is of some usefulness, there are a number of deficiencies that restrict its adaptability. One limitation of this design is that the slots in the bar provide a range of only a limited number of gunwale widths to which the device may be usefully affixed. In practice, however, there are a great many gunwale widths, and even a single craft can provide a significant variation in gunwale width as one transits from fore to aft. Another limitation of the Tamiso device is the failure to take into account the force exerted on the craft even by the smallest of trolling motors. Leaving the motor with essentially a single point-of-contact relationship with the craft can produce significant stress on the mounting bar as well as on the craft's gunwale. Moreover, this arrangement likely results in a loss of a portion of the useful thrust exerted by the motor on the craft in that torquing, shimmying, etc., that may occur from the single point-of-contact is lost to the water rather than directed to the craft.

U.S. Pat. No. 4,382,574 issued to Ellestad describes a motor mount specifically for canoes, which is one application for the present invention. The Ellestad device includes a pair of rails that are affixed to the canoe's gunwales, with a pair of movable bars affixed to the rails. The motor is apparently coupled to one of the bars, each of which is designed to pivot on the rails. This device fails to permit complete and easy freedom of transfer of the mount, and therefore the motor, from one location to another on the entire craft. That is, the rails would have to extend essentially the entire length of the craft. In addition, the bars are designed to be fixed in a single location on the rails, thereby limiting the range of gunwale widths to which the device may be affixed. Further, the Ellestad device involves the application of considerably more components than is reasonably necessary to achieve complete and easy mobility of the motor mount.

Other prior devices, including those described by McCoy (U.S. Pat. No. 5,005,798) and Mould (U.S. Pat. No. 1,663,260), fail to provide the means to enable the user of a trolling motor complete adaptability and effectiveness with modern-day watercraft. Specifically, McCoy and Mould fail to take into account the need to transfer as much of the motor's thrust into craft movement in that they use essentially single point-of-contact coupling. This may not be necessary when the device is used on older craft made of extremely rigid materials. However, present-day craft are made of durable, but relatively more flexible materials, such as aluminum, fiberglass and other non-metallic materials. Thus, the need for gunwale mounts with at least two points of contact is particularly important with current and future watercraft.

Therefore, what is needed is a mount for a trolling motor that is quickly and easily moved from one location to another on a craft. What is also needed is such a motor mount that takes advantage of the thrust available from the motor for movement of the craft. Further, what is needed is a trolling motor mount that addresses the design features of modern craft, including the materials used to make their gunwales.

SUMMARY OF THE INVENTION

It is an object of the present invention to provide a trolling motor mount that may be quickly and easily moved from one location to another on a craft. It is also an object of the present invention to provide such a mount that further takes advantage of the thrust available from the motor for movement of the craft. Finally, it is an object of the present invention to provide a trolling motor mount that addresses the design features of modern craft, including the materials used to make their gunwales.

These and other objectives are achieved in the present invention through the application of an outboard motor mount that is connected to a rail system providing three-point contact with the craft to which it is affixed. The device further includes an incrementally adjustable cross member that ties one gunwale to the other for complete stability of the mount, not only when the motor is in use, but particularly when the motor is in the raised or out-of-service position. An optional and supplementally safe feature of the present invention is a safety switch that is positioned internal to the mount and that decouples the motor from the battery when the motor's propeller is forced out of the water.

The three-point coupling arrangement includes three sets of rail clamps, all of which are preferably supplied with cushioning material that ensures a secure coupling between the clamp and the gunwale rail, and that does so without damage to the rail and to the hull surfaces as well. The three clamps are placed in a triangular arrangement, with a pair on one side of the craft and the third on the other. The aft one of the one-side pair is linked to the third clamp by means of a cross-member support that includes a turnbuckle which provides the capability for incrementally adjusting the spacing between the two noted clamps. The pair of clamps that is on the same side of the craft are structurally coupled together by means of an outboard support that is detachably affixed between the motor mount, which is connected to the fore clamp of the pair, and the aft clamp of that pair. The outboard support is designed to permit the user to easily transfer the device from one side of the craft to the other. It may be fabricated in a variety of ways and of a variety of materials. Preferably, the outboard support is a unitary elbow design, but may also be a jointed and/or multi-member piece. A thruster bar preferably is connected between the pair of clamps and runs along the gunwales to enhance the transfer of the thrust supplied by the motor.

Through this arrangement, the present invention is quickly and easily moved to any location on the craft. Further, it permits adjustment in width such that it may be coupled to virtually any craft width. The combination of the three clamps, along with the thruster bar and the solid connection between the fore and aft same-side clamps, ensures the maximum possible thrust transfer. This design also results in craft stability while under way, even at maximum trolling speed. The user is not restricted to locating himself or herself at the stern of the craft. Instead, he or she may move freely about the craft and remain in close proximity to the motor.

An optional important component of the present invention is the safety switch. It is preferably formed internal to the mount, with simple battery posts extending through the mount for remote coupling to the battery, which may be positioned anywhere in the craft. A receptacle for the motor's shaft accepts that shaft. When the shaft fully engages the receptacle, a coupling block is forced to complete a circuit between the low- or ground-potential posts of the mount and the remotely-located battery. When the motor's shaft moves outwardly, such as when the motor is to be taken out of the water, or when it is unintentionally moved outwardly, as when the propeller hits an underwater obstruction, the circuit is broken and the motor's power cut off. In this way, there is no possibility for the propeller to come out of the water at an operating rate that could cause injury to the boater or canoeist.

It is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

BRIEF DESCRIPTION OF THE DRAWINGS

FIG. 8 is a front side view of the cross-member support of the present invention, coupled to the third rail clamp.

FIG. 9 is a rear side view of the cross-member support of the present invention, coupled to the third rail clamp.

FIG. 10 is a partial cross-sectional view of the interior of the optional motor mount, showing the optional safety switch of the present invention.

DETAILED DESCRIPTION OF THE PREFERRED EMBODIMENT

Figure 1:
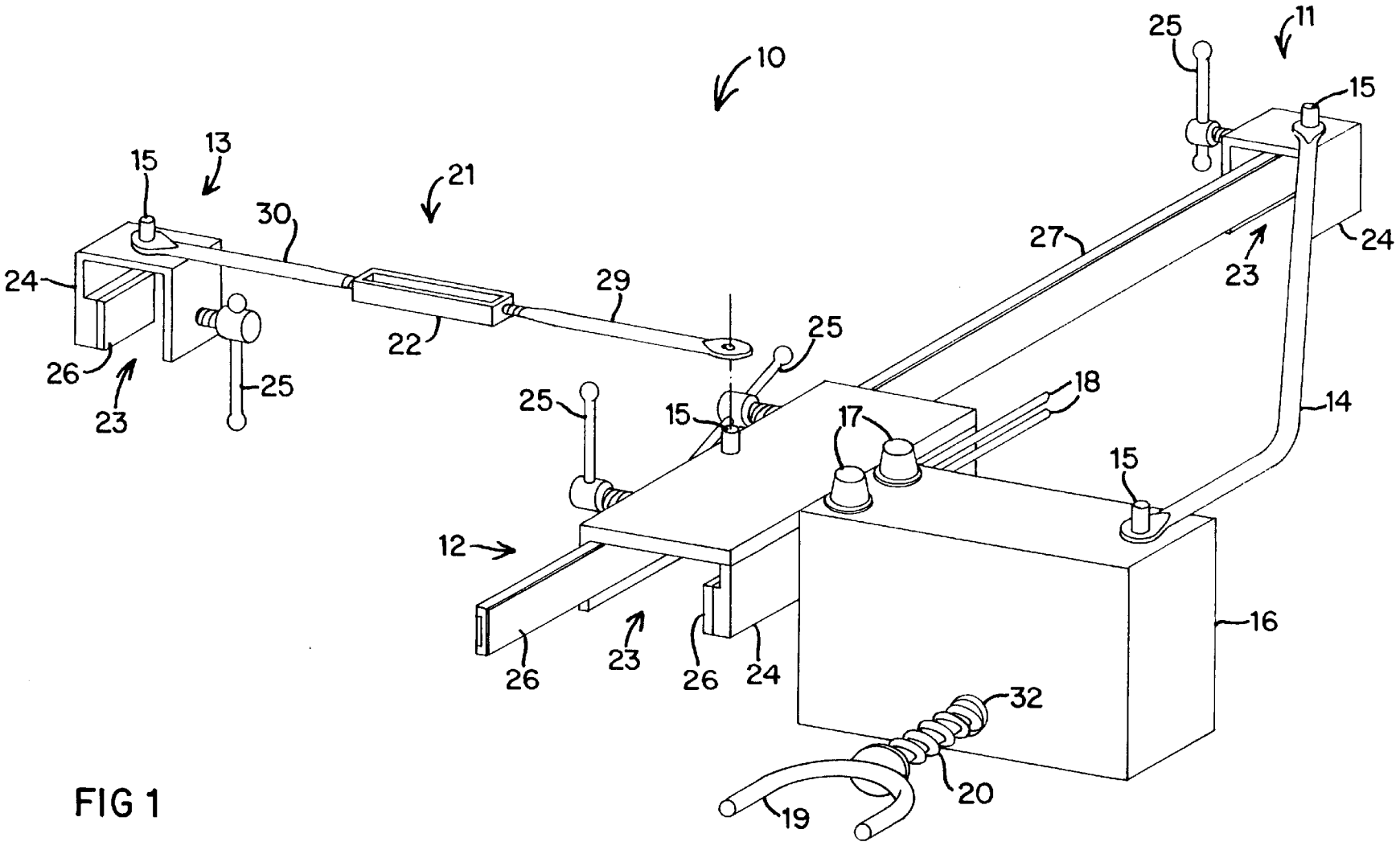
FIG. 1 is a perspective view of the present invention.
Figure 2:
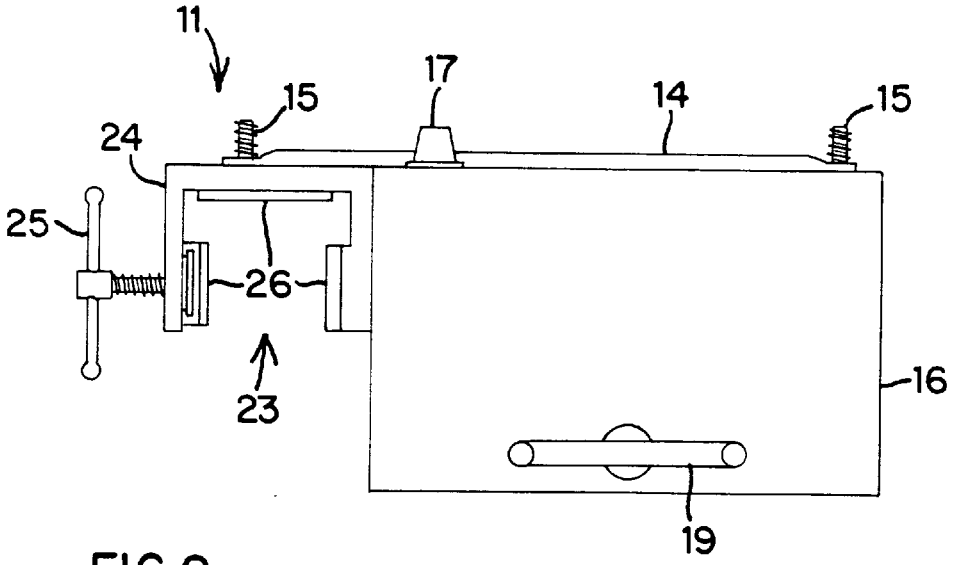
FIG. 2 is a rear side view of the motor mount and the first rail clamp of the present invention.
Figure 3:
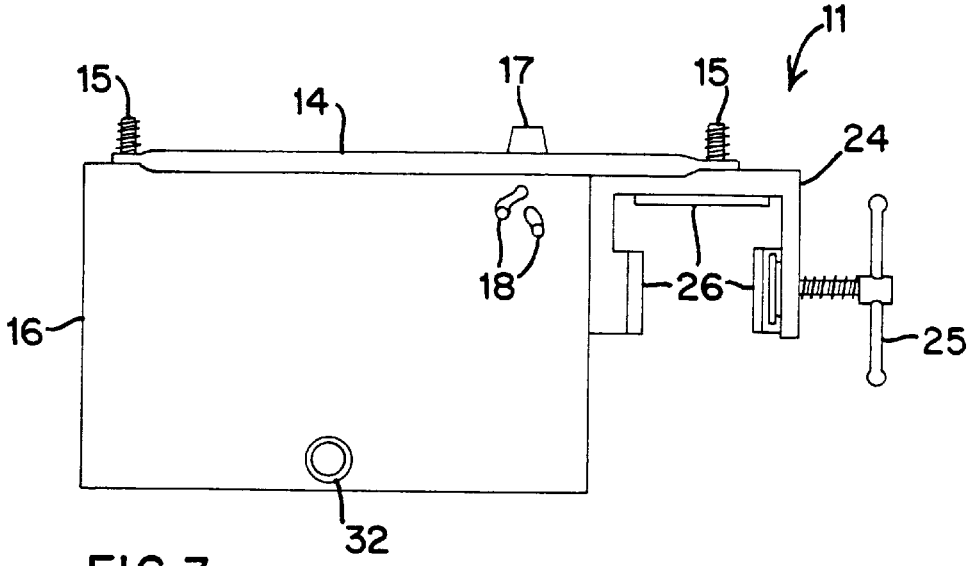
FIG. 3 is a front side view of the motor mount and the first rail clamp of the present invention.
Figure 4:
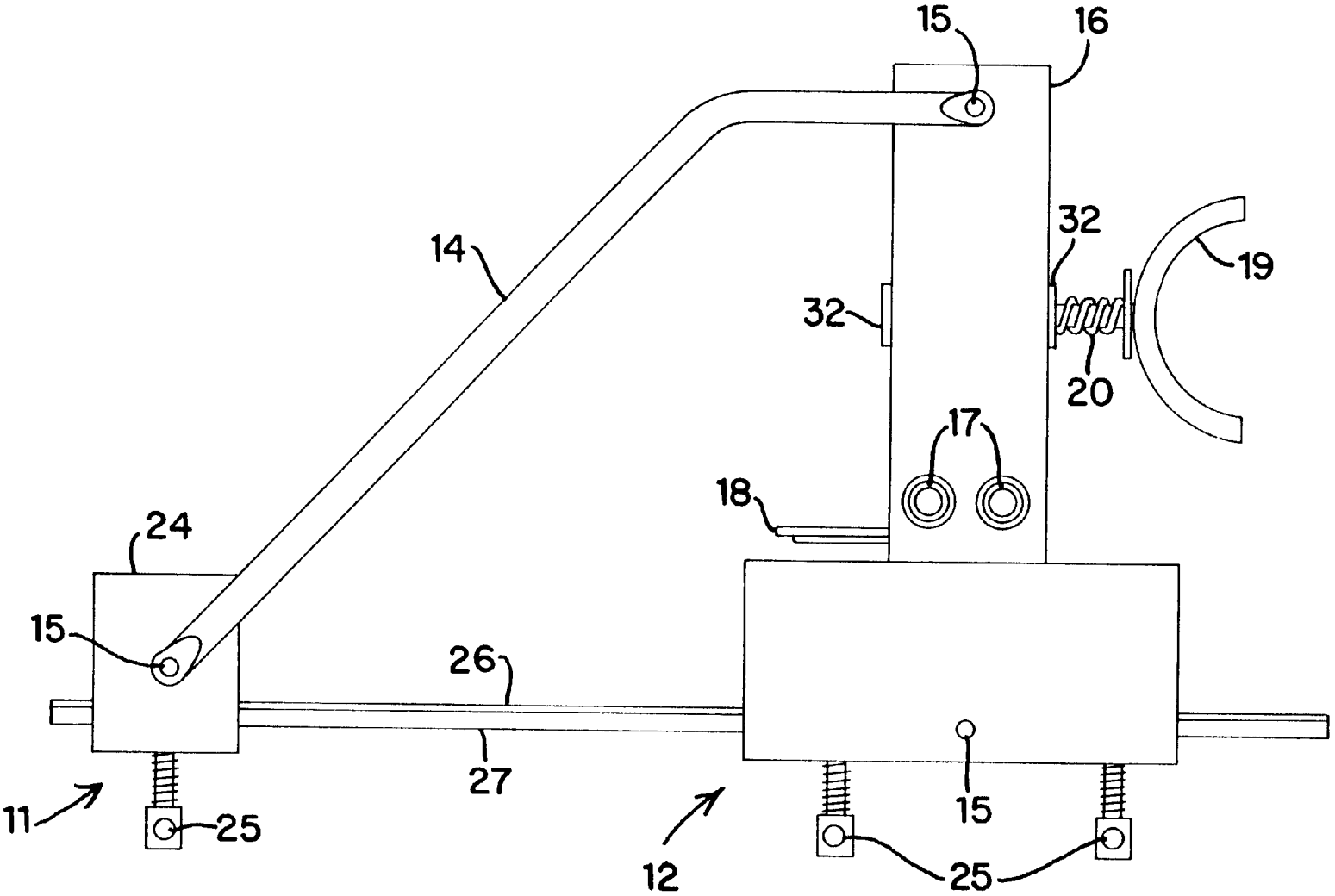
FIG. 4 is a top view of the motor mount of the present invention.
Figure 5:
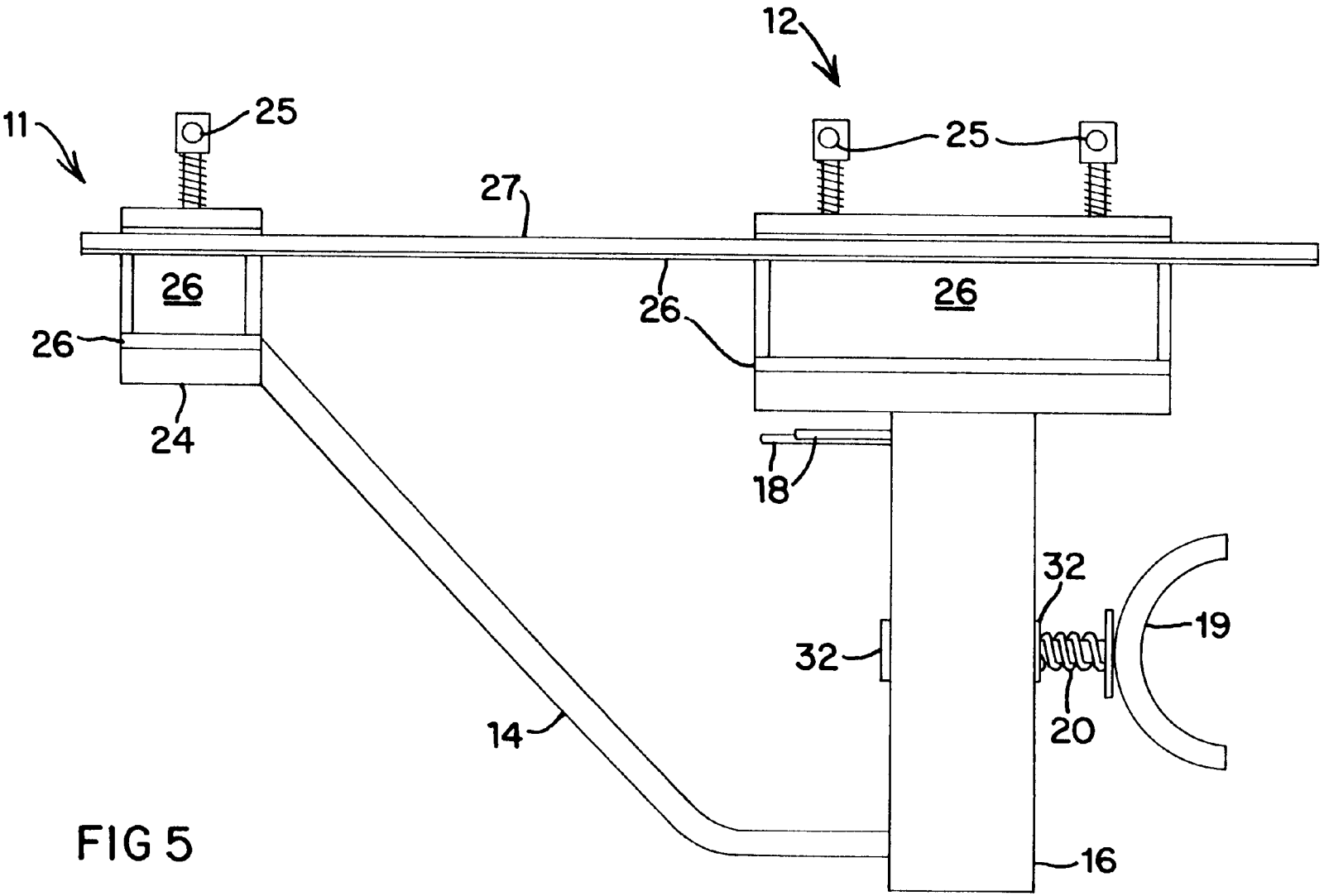
FIG. 5 is a bottom view of the motor mount of the present invention.
Figure 6:
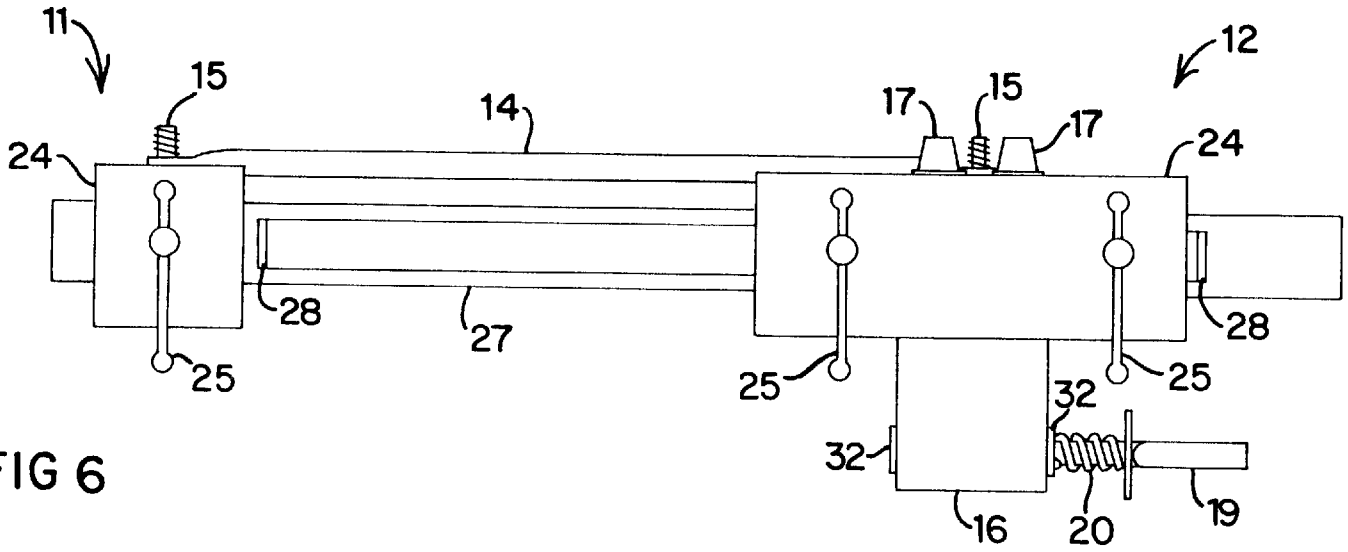
FIG. 6 is an inside side view of the pair of rail clamps of the present invention.
Figure 7:
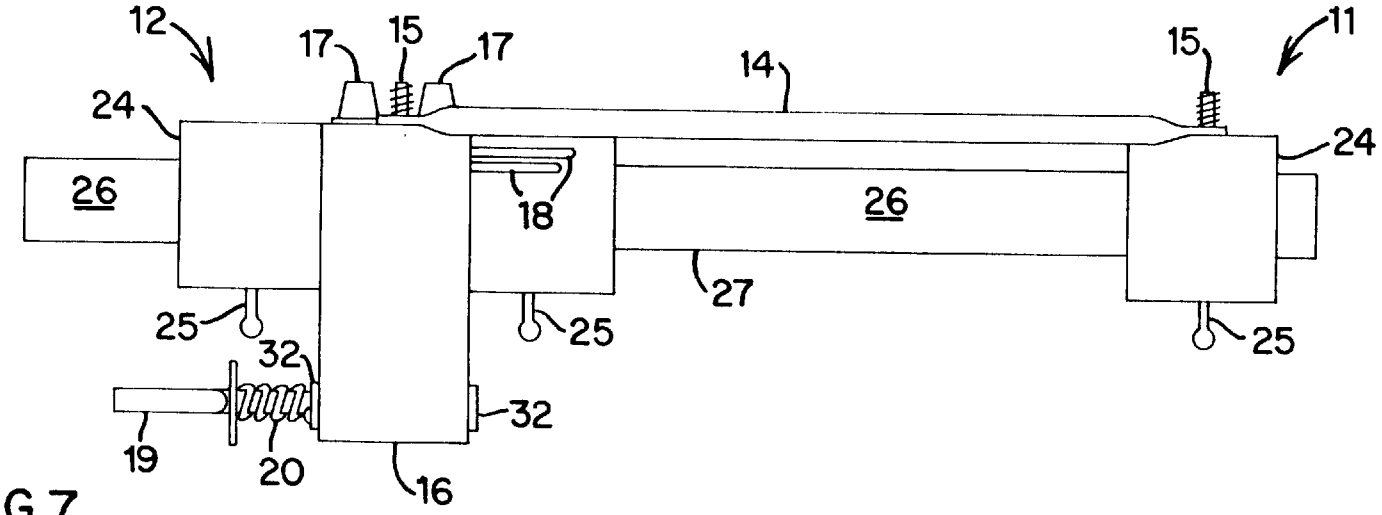
FIG. 7 is an outside side view of the pair of rail clamps of the present invention.

The present invention, a motor mount device 10, is shown in FIGS. 1–9. As illustrated, the device 10 includes a first rail clamp 11, a second rail clamp 12, and a third rail clamp 13. The first rail clamp 11 is preferably placed fore of the second rail clamp 12 on a first side gunwale of a watercraft (not shown). Those two clamps are preferably coupled together via an outboard support 14, that may be a unitary elbow rod, or that may also be a jointed multi-piece component. The outboard support 14 is detachably coupled to the first clamp 11 and the second clamp 12 by means of a threaded rod and ring arrangement 15, although any suitable means for permitting easy coupling and uncoupling of the two clamps is permissible. It is to be noted, however, that use of the rod and ring arrangement 15 permits the user to easily transfer the device 10 from one side gunwale to another.

The second clamp 12 is coupled to a motor mount 16 by any variety of means, including, but not limited to, bonding, welding, bolting, etc. The motor mount 16 may be simply a bar, block, or other component suitable for holding the weight of a motor. Optionally, and as shown in the accompanying drawings, the motor mount 16 includes means for ensuring safety of the operation of the motor. That safety means includes a pair of external contact posts 17 couplable to a supply battery (not shown) by way of battery cables 18, and to internal coupling contacts shown in FIG. 10. The safety means further includes a motor shaft receptacle 19 with a spring-loaded receptacle shaft 20 for coupling to mechanical components internal to the motor mount 16.

The coupling between the second clamp 12 and the third clamp 13 occurs across the watercraft's gunwales. That is, the third clamp 13 is detachably connectable to a second side gunwale of the watercraft. This coupling is achieved with an incrementally-adjustable cross-member support 21 that structurally links the two clamps together. The support 21 includes a turnbuckle 22 permitting fine adjustment of that piece. As with the structural coupling between the first clamp 11 and the second clamp 12, the support 21 preferably detachably connects the second clamp 12 and the third clamp 13 together with means such as the threaded rod and ring arrangement 15.

Each of the clamps 11–13 may be detachably connectable to its respective gunwale with adjustable clamping components 23 that may simply be channel material 24 placed over the water craft's rails and clamped to those rails as by means of adjustable C-clamps 25 of the type well known to those skilled in the art. This arrangement permits easy and quick coupling and uncoupling and further minimizes gunwale damage. Of course, the application of cushioning material 26 further minimizes gunwale damage--of particular importance with the present-day non-metallic materials used to fabricate watercraft. Optionally, and to ensure that the motor is stably affixed to the watercraft, the second clamp 12 may include a plurality of adjustable C-clamps 25 and a larger channel member 24 than is used in the formation of the first clamp 11 and the third clamp 13. Of course, other structural means for linking the clamps together and the motor to the device 10, provided the three-point contact and adjustability of width is kept.

An advantageous optional component of the device 10 is a thruster plate 27 that enhances the structural stability of the device 10 and that likely increases the amount of thrust transferred from the motor to movement of the watercraft. The thruster plate 27 may be formed of any suitable reinforcing material, including, but not limited to, Aluminum or steel bar. The thruster plate 27 is preferably designed to extend a distance that is slightly greater than the distance between the first clamp 11 and the second clamp 12. The thruster plate 27 preferably includes the cushioning material 26, which may be any sort of material with give, including, but not limited to, rubber strips. It is important, however, that the cushioning material have sufficient strength such that there is a transfer of clamping strength from the C-clamps 25 to the channels 24, the thruster plate 27, and to the watercraft's gunwales. The thruster plate 27 may include optional stops 28 for limiting the extent to which the interior clamping components of C-clamps 25 may travel on the thruster plate 27.

As illustrated in FIGS. 1 and 9, the cross-member support 21 includes the incrementally-adjustable turn buckle 22 that links a first support piece 29 and a second support piece 30 together and, thereby, the second clamp 12 and the third clamp 13 together. While other incremental designs may be known to those skilled in the art, this arrangement has been determined to be the most mechanically- and cost-effective way to link the two noted rail clamps together in a way that permits easy adjustment and easy transfer.

An optional useful component of the present invention is a safety switch 31 shown partially in FIGS. 1–7 and completely in FIG. 10. The safety switch 31 includes the relationship between the motor shaft receptacle 19 and the battery cables 18 that are connectable to a remotely-positioned battery. It is to be noted that enabling placement of the battery remote from the motor eases the user's capability to move about the watercraft without getting tied up in short cabling lines. Continuing with the description of the safety switch 31, the spring-loaded receptacle shaft 20 is preferably inserted through a mount bushing 32 having a shaft sleeve 33. There may be two such bushing 32 and sleeve 33 aspects—one on each side of the mount 16—so that the receptacle 19 may be placed on either side of the mount 16. This design permits sliding movement of a symmetrically-designed switch lever 34 through the sleeve 33. The switch lever 34 is coupled to the receptacle shaft 20 so that when the motor shaft engages with, and disengages from, the receptacle 19, the switch lever 34 moves in the sleeve 33.

Within the mount 16, a tapered section of the switch lever 34 has as its narrowest point a centered section of the lever 34. The tapered section engages a switch push rod 35 such that when the receptacle shaft 20 moves inward to the mount 16 upon being displaced by the motor shaft coming in contact with the receptacle 19, the wider portions of the tapered section of the switch lever 34 force movement of the push rod 35. A lever stop 36 limits the extent of movement of the switch lever 34 into and out of the sleeves 33 of the mount bushings 32. The push rod 35 is coupled via spring loading to a switch plate 37 that is designed to engage with safety contacts 38. The safety contacts 38 are designed to couple a negative post 39 of the motor mount 16 with a negative post of the remotely-located battery. When the motor shaft forces the receptacle shaft 20 inward to the mount, indicating that the motor's propeller is completely in the water, the switch lever 34 forces the push rod 35 to move the switch plate 37 into contact with the safety contacts 38, thereby causing a complete circuit-provided, of course, the battery cables are engaged to the posts 17 and the remotely-located battery. If and when the motor shaft moves outwardly, the pressure on the receptacle shaft 20 is reduced, to the point where the contact between the safety contacts 38 and the switch plate 37 is removed, the circuit is broken, and the motor ceases to operate. A positive post 40 of the motor mount 16 preferably remains at all times engaged with the positive post of the battery.

It should be understood that the preferred embodiments mentioned here are merely illustrative of the present invention. Numerous variations in design and use of the present invention may be contemplated in view of the following claims without straying from the intended scope and field of the invention herein disclosed.

I claim:

1. A motor mount device for use on a watercraft, said motor mount device comprising:

a. a first clamp removably attachable to a first position on a first gunwale of said watercraft, said first position being adjustable along said first gunwale;

b. a second clamp removably attachable to a second position on said first gunwale of said watercraft, said second position being adjustable along said first gunwale:

c. a motor mount detachably affixed to said second clamp;

d. a third clamp removably attachable to a second gunwale of said watercraft; and e. an incrementally adjustable cross member connecting said second clamp to said third clamp, said cross member including a turnbuckle for incrementally adjusting a length of said cross member, wherein said first clamp, said second clamp, and said third clamp are coupled together to secure said motor mount to said watercraft, and wherein said first clamp, said second clamp, and said third clamp are independently adjustable with respect to one another in their positioning on said watercraft, such that said first position on said first gunwale can be freely changed independent of said second position on said first gunwale.

2. The motor mount device as claimed in claim 1 wherein said motor mount includes a safety switch, said safety switch forming a portion of said motor mount, and said safety switch including a motor shaft receptacle for receiving a shaft of a motor attached to said motor mount, wherein said motor shaft receptacle includes means for completing a power circuit when said shaft engages said receptacle.

3. The motor mount device as claimed in claim 2 wherein said means for completing said power circuit includes a receptacle shaft of said receptacle, wherein said receptacle shaft is coupled to a push rod for forcing a switch plate to engage safety contacts that are designed to couple a negative post of said motor mount with a negative post of a battery when said receptacle shaft is moved by contact between said receptacle and said motor shaft.

4. A motor safety switch for regulating power to a watercraft motor, said safety switch comprising:

a. a receptacle for receiving a shaft of said motor;

b. a receptacle shaft forcibly engageable with a switch lever;

c. a push rod coupled to said switch lever, wherein when said shaft of said motor engages said receptacle, said push rod is forced into contact with a switch plate; and d. a pair of contacts couplable with said switch plate when said motor shaft engages said receptacle, and decouplable when said motor shaft does not engage said receptacle, wherein said pair of contacts are designed to complete a connection to a negative post of a battery.

5. A motor mount device for use on watercraft of various widths, said motor mount device comprising:

a. a first clamp removably attachable to a first gunwale of a watercraft at any point thereon;

b. a second clamp removably attachable to said first gunwale of said watercraft in an adjustably-spaced relation along said first gunwale to said first clamp, wherein said second clamp is coupled to said first clamp;

c. a motor mount for supporting a motor used to move said watercraft through the water, wherein said motor mount is detachably affixable to said second clamp;

d. a safety switch forming a portion of said motor mount, wherein said safety switch is designed to disconnect a battery coupled to the motor when the motor is displaced from the water;

e. a third clamp removably attachable to a second side gunwale of said watercraft in an adjustably-spaced relation to said second clamp; and f. an incrementally adjustable cross member connecting said second clamp to said third clamp.

* * * * *